United States Patent [19]

Nakaoka et al.

[11] Patent Number: 4,773,948

[45] Date of Patent: Sep. 27, 1988

[54] METHOD OF PRODUCING SILICON IRON SHEET HAVING EXCELLENT SOFT MAGNETIC PROPERTIES

[75] Inventors: Kazuhide Nakaoka; Yoshikazu Takada; Junichi Inagaki, all of Kanagawa; Akira Hiura, Yokohama, all of Japan

[73] Assignee: Nippon Kokan Kabushiki Kaisha, Tokyo, Japan

[21] Appl. No.: 22,642

[22] PCT Filed: Jun. 13, 1986

[86] PCT No.: PCT/JP86/00300

§ 371 Date: Jan. 30, 1987

§ 102(e) Date: Jan. 30, 1987

[87] PCT Pub. No.: WO86/07390

PCT Pub. Date: Dec. 18, 1986

[51] Int. Cl.[4] ..... H01F 1/04

[52] U.S. Cl. ..... 148/111

[58] Field of Search ..... 148/111, 112

[56] References Cited

U.S. PATENT DOCUMENTS 4,592,789 6/1986 Kawamo et al. ..... 148/111

4,615,750 10/1986 Mochinaga et al. ..... 148/111

*Primary Examiner*—John P. Sheehan

*Attorney, Agent, or Firm*—Henry C. Nields

[57] ABSTRACT

Fe alloy containing Si: 4.0 to 7.0 wt %, Mn: not more than 0.5 wt %, P: not more than 0.1 wt %, S: not more than 0.02 wt %, Al: not more than 2 wt % is molten, and made an ingot or continuously cast into a piece. The piece is subjected to slabbing-roughing, otherwise roughing at temperature of more than 1000° C. and at total reduction of more than 50%, and further a hot finish rolling. The hot finish rolling is performed at temperature of not more than 1100° C. and under a total reduction which is specified by a relation between average grain diameter before the hot finish rolling and Si content, and coiled at temperature of not more than 750° C. after the rolling. The hot rolled plate is performed with cold rolling or warm rolling after the descaling and hot rolled strip annealing. If required, an intermediate annealing is performed in the course of the cold (or warm) rolling.

4 Claims, 2 Drawing Sheets

METHOD OF PRODUCING SILICON IRON SHEET HAVING EXCELLENT SOFT MAGNETIC PROPERTIES

TECHNICAL FIELD

The present invention relates to an improvement of a method of producing high silicon iron sheet of more than 4wt % Si having excellent soft magnetic properties by hot rolling and cold rolling processes.

BACKGROUND TECHNIQUE

Silicon iron alloys have excellent soft magnetic properties, and have been much used as magnetic cores of electric transformers or material for other electric devices. It is known that the more Si content, the more improved are the soft magnetic properties, and these properties show peaks at around 6.5 wt %. However, if Si content were more than 4.0 wt %, an elongation would be rapidly decreased, and ordinary cold rolling could not be practiced. Therefore it has been regarded as impossible to industrially produce sheet containing Si of more than 4 wt %.

This invention has been developed in view of such circumstances, and is to provide a method of effectively producing high silicon iron sheets of more than 4 wt % Si via the rolling processes.

DISCLOSURE OF THE INVENTION

In the invention, a molten Fe alloy is produced, which comprises Si: 4.0 to 7.0 wt %, Mn: not more than 0.5 wt %, P: not more than 0.1 wt %, S: not more than 0.02 wt % and Al: not more than 2 wt %. The produced alloy is made an ingot or slab by a continuous casting, subjected to a slabbing-roughing, or a roughing at a temperature of more than 1000° C. and at total reduction of more than 50%, performed thereon with hot finish rolling under conditions specified as follows, and coiled at a temperature of not more than 750° C. The oxide scale of the hot rolled strip or plate is removed by pickling or grinding, and after trimming if required, entered to a cold rolling. The cold roller strip or sheet is subjected to an annealing for improving the magnetic properties. The annealing is done at a temperature of the cold rolled strip or sheet being more than 800° C.

The most noted thing in the invention is said hot finish rolling at a temperature of not more than 1100° C. and the total reduction R(%), and the coiling at not more than 750° C.

The total reduction R(%) is defined as follows.

Assuming that d(mm) is an average grain diameter before the hot finish rolling, and when $\lambda_0$ is given by a following equation of $$\lambda_0 = 1.90 - 0.26 \times Si(wt\ \%),$$

if $d > \lambda_0$, $R(\%) \geqq (1 - \lambda_0/d) \times 100$, and if $d \leqq \lambda_0$, $R(\%) \geqq 0$.

Herein, if $R(\%) = 0$, the hot finish rolling is not of course carried out, and this invention also includes such a case.

The invention will be explained in detail.

The inventors made many experimental studies on an improvement of cold workability with respect to the above mentioned high silicon iron alloys, and found that if selecting the hot finish rolling conditions in response to a microstructure before the hot finish rolling, a hot rolled plate having excellent cold workability might be produced, and that the cold workability of silicon iron alloys was regulated by a microstructural parameter of the hot rolled plate.

FIG. 1 shows the cold workability of 6.5% silicon iron alloy, in which lateral and vertical axes indicate the average grain diameter d(mm) before hot finish rolling and the total reduction R(%) of the hot finish rolling respectively.

The figure was obtained by investigating the samples with various average grain diameter, which were prepared from the 50 kg ingots. The samples were soaked at a temperature of 1000° C., and hot-rolled by 6 passes to each amount of the total reduction. The finish temperature was 650°±10° C.

In the figure, O indicates that no edge cracks generated when the hot-rolled plates were cold-rolled at the total reduction of 85%, in other words, the cold workability was preferable. X indicates that the cracks were generated at the beginning of said cold rolling and further rolling was impossible.

From this figure, it is obvious that when the average grain diameter d(mm) before the hot finish rolling is large, large hot rolling reduction is necessary to undertake the cold rolling (for example, when the average grain diameter is 3 mm, the total hot rolling reduction of more than 95% is necessary), and on the other hand, if the average grain diameter were small, the cold rolling would be possible even if the reduction at the hot finish rolling were small (for example, when the average grain diameter is 0.32 mm, the cold rolling is possible even if the total reduction is 40%).

In addition, if said average grain diameter were less than a certain determined value, the cold rolling would be possible without the hot finish rolling.

The microstructure obtained by said hot finish rolling is fibrous or lamellar where the grains are elongated in the rolling direction, while polygonal is the microstructure when the total reduction at the hot finish rolling is zero. From this result, it is seen that if a microstructural parameter, that is, average spacings λ(mm) betweeen grain boundries in the direction of plate thickness were introduced, irrespectively of differences in the morphology of microstructure, general cold workablity could be explained by λ. λ corresponds to the average grain diameter in thickness direction when the structure is fibrous or lamellar, and when it is polygonal, λ becomes the same as the average grain diameter which is usually defined. The recrystallizing temperature of this kind of alloy is 1000° to 1100° C. Therefore, λ of the fibrous structure provided by the hot finish rolling at the starting temperature of not more than 1100° C., quite agrees to a value calculated by the average grain diameter before the hot finish rolling and the total hot rolling reduction, since the recrystallization scarcely takes place in said temperature range and the grains are only crushed evenly in the thickness. A curve of FIG. 1 shows calculated total reduction of the hot finish rolling, as λ becomes 0.2 mm. This curve shows a very good agreement to boundaries between the cold rolling possible range and impossible range. From this fact it is seen that the cold rolling is possible by lowering λ below 0.2 mm in the 6.5 wt % silicon iron alloy, irrespectively of shapes of crystal grains. If λ=0.2 mm is assumed as a critical value and expressed with $\lambda_0$, $\lambda_0$ is varied by Si content. That is, when $\lambda_0$ was gained by the same experiment as FIG. 1 with respect to the alloys of 1 to 6 wt % Si, a result was shown in FIG. 2. If $\lambda_0$ is expressed as a function of Si content from said result, $$\lambda_0 = 1.90 - 0.26 \times \text{Si(wt \%)}.$$

From the above mentioned result, it was possible to clarify the hot finish rolling conditions for producing the hot rolled plate suitable to the cold rolling. However the average grain diameters of the ingots or the continuously cast slabs ordinarily produced are large, and in order to refine the average spacings between the grain boundaries in the thickness direction less than $\lambda_0$, the total reduction thereof must be extremely large, and in such a condition the ingot or slab is frequently cracked. Therefore, it is necessary to refine the microstructure of the ingot or the continuously cast slab prior to the hot finish rolling. By forming the fibrous (lamellar) structure, the refinement to a certain extent could be accomplished, but if utilizing the recrystallization, the refinement could be more effectively carried out. In the inventors' studies, if the hot rolling of more than 50% was done at the temperature of more than 100020 C., the microstructure of the high silicon iron alloy could be refined without generating crackings. If the alloy is subjected to the slabbing or the roughing prior to the hot finish rolling under the above mentioned conditions, it is possible to produce an intermediate material (for example, roughed bar material) to be entered to the hot finish rolling by using the ingot or the continuously cast slab.

The above mentioned findings may be summarized as under (1) The cold workability of the high silicon iron alloy depends upon the average spacings $\lambda$(mm) between the grain boundaries in the thickness direction prior to the cold rolling.

(2) If said spacings are made less than a certain critical value $\lambda_0$ (mm) which is determined by the Si content, an excellent cold workablity could be provided.

(3) The hot finish rolling conditions are specified so as to realize the above mentioned $\lambda_0$, and they must be decided in response to the average grain diameter d (mm) prior to the hot finish rolling. That is, in the hot finish rolling at the temperature of below 1100° C. where the recrystallization does not take place, the reduction should be made by a value $\{(1-_0/d \times -100(\%)\}$ which is decided geometrically from the values of $\lambda_0$ and d.

(4) For realizing said hot finish rolling, the refinement through the roughing or slabbing is required, and it is accomplished by the rolling at the temperature of above 1000° C. and at the total reduction of more than 50%.

(5) If the average spacings between the grain boundaries in the thickness direction of less than said $\lambda_0$ (mm) were obtained by the roughing or slabbing conditions, the material per se displays the excellent cold workability (not undertaking the hot finish hot rolling).

This invention is based on the above mentioned concept, and references will be made in detail to the specifying conditions and others.

(Composition of steel)

Si is an element which improves the soft magnetic properties, and it displays the most excellent effect at around 6.5wt %. The invention specifies Si content 4.0 to 7.0 wt %. If Si were less than 4.0 wt %, no problem would occur about the cold workability, and if it were more than 7.0 wt %, soft magnetic properties would be deteriorated through increment of magnetostriction and decrement of saturation induction and maximum permeability and in addition, cold workability would be extremely bad. Thus, the range of Si is 4.0 to 7.0 wt %.

Mn is added to fix S as an impurity. But if Mn content were increased, the workability would be worsened and if MnS were increased, bad influences would be given to the soft magnetic properties, hence Mn≦0.5 wt %.

P lowers iron loss. However, if P content were increased, the workablity would be worsened and it is specified as P≦0.1 wt %.

S is required to be lessened as possible as mentioned above, and the invention specifies S≦0.02 wt %.

Al is added for deoxidation at preparing the molten steel. Further, it is known that Al fixes solute N which deteriorates the soft magnetic properties, and electric resistance is increased. By adding enough Al it is possible to coarsen the size of precipitated AlN until it has scarce resistance against moving of magnetic domain wall. However, if Al were added too much, the cold workability would be made bad, and a cost-up would be invited, and therefore it is Al≦2 wt %.

C is a harmful element which increases the iron loss and is a main factor of a magnetic aging, and is desirous to be less. But since C enlarges $\gamma$ loop of Fe-Si equilibrium diagram, and $\gamma-\alpha$ transformation point appears during cooling if an apt amount to be determined by Si content is added, a heating treatment utilizing said transformation would be possible. Therefore, it is preferable that C is not more than 1 wt %.

(Slabbing-roughing conditions)

The cast alloy is undertaken with the slabbing and roughing if it is an ingot, and it is done with the roughing if it is a continuously cast slab. These rolling conditions are decided for performing the refinement by recrystallization. In a slab of silicon iron alloy, the recrystallization does not take place at the tempertures of less than 1000° C., and if the rolling were forcibly carried out at ranges of said temperatures, cracks would be created, and therefore the rolling temperature is more than 1000° C. Further, for accomplishing satisfied refinement, strain of more than 50% is required, and the total reduction be specified more than 50%.

(Hot finish rolling conditions)

As having mentioned, based on a premise of fibrous (or lamellar) microstructure, the rolling should be begun at the temperature of not more than 1100° C. If the total reduction is assumed as R(%), $\lambda$ is geometrically decided by d and R, and so $R \geqq (1-_0/d) \times 100(\%)$ is required for satisfying $\lambda \leqq \lambda_0$. However, if $d \leqq \lambda_0$ is obtained by the roughing or other means, the hot finish rolling is not necessary in view of the cold workability. But the rolling is necessary in the practical requires or, and in such a case, the reduction is $R \geqq 0$. In the case of polygonal microstructure, the cold rolling is also possible if $\lambda \leqq \lambda_0$ is realized.

A reason for specifying the coiling temperature of not more than 750° C. is why the recrystallization and the grain growth happen during cooling the coil if coiling more than 750° C.

(Cold (or warm) rolling and annealing conditions)

Warm rolling in which the temperature of rolled sheet is less than 400° C., is also possible instead of the cold rolling on the hot rolled plates, and such a warm rolling is effective to improve the workability.

The annealing after the cold or warm rolling is carried out for imparting magnetic properties to the silicon iron sheet, and the annealing is done at the temperature of the sheet being more than 800° C. If the annealing temperature were less than 800° C., the excellent magnetic properties would not be provided since the crystal grains are too fine.

Apart from the above mentioned annealing, it is possible to carry out the annealing on the hot rolled plate at the temperature of not more than 750° C. before the cold rolling, otherwise carry out an intermediate annealing at the temperature of not more than 750° C. in the course of the cold rolling. These annealings are for improving the cold workability and accomplishing decarburization, and both are done if required.

EMBODIMENTS FOR PRACTICING THE INVENTION

(EXAMPLE 1)

Figure 1:
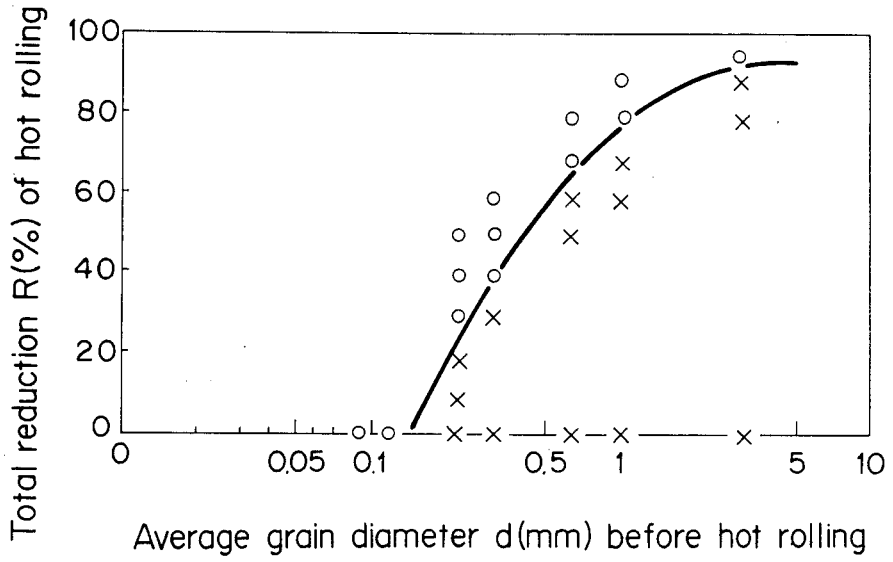
FIG. 1 is a graph showing a range where no cracks are generated in a relation between the average grain diameter before the hot finish rolling and the total reduction during the hot finish rolling.
Figure 2:
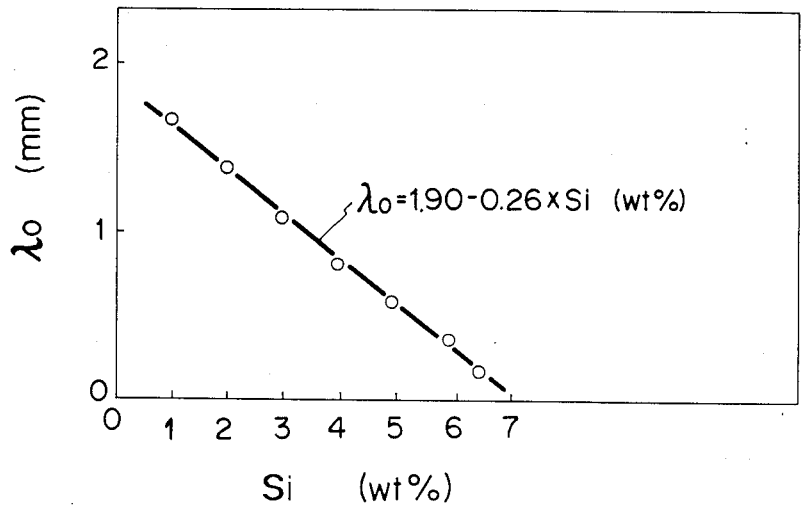
FIG. 2 is a graph showing a relation between Si content and $\lambda_0$.
Figure 3:
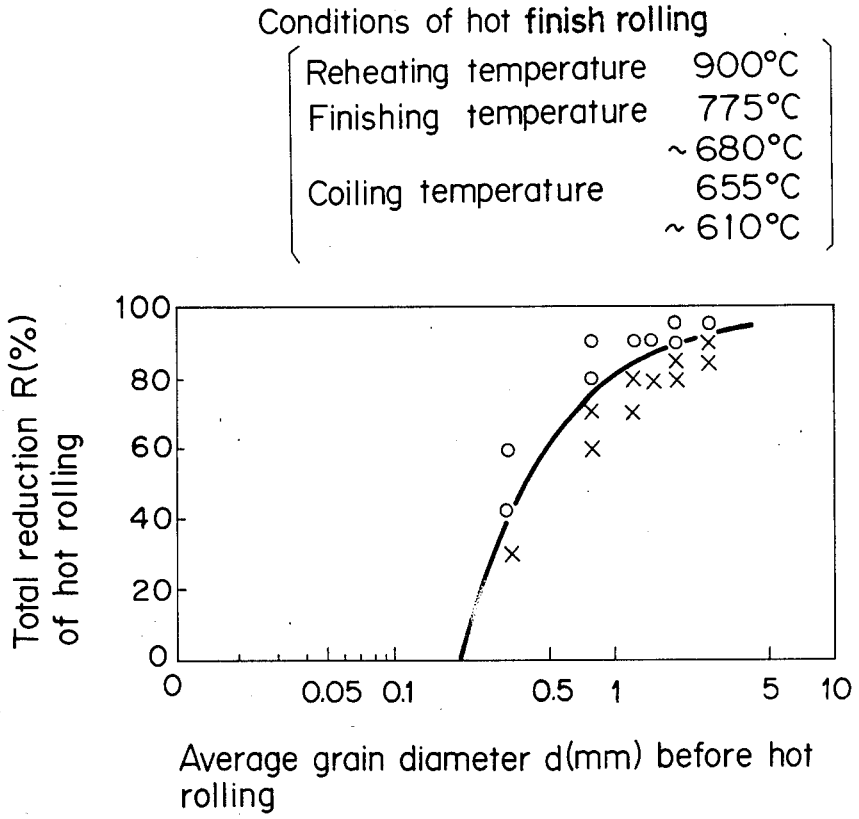
FIG. 3 is a graph showing a scope realized in the embodiment where the cold rolling is possible.

The continuously cast slabs (thickness: 200 mm) having the chemical composition shown in Table 1 were heated at the temperatures of 1200° C. and 1300° C. for 3 hours respectively, immediately followed by the roughing. The roughings were performed by 5 passes, and the slabs were practiced with pass schedules of each 3 levels for changing the grain size. Subsequently, these materials were heated at the temperature of 900° C. and, after 30 minutes, entered into the hot finish rolling. The objective finish thicknesses were selected by each of several standards in response to the average grain sizes of the roughed bar materials with reference to the result of FIG. 1. The finishing temperatures were 77520 to 680° C. and the coiling temperatures were 655° to 610° C. The hot finish rolled strips were subjected to the cold rolling after the pickling, and the cold workability was tested as in FIG. 1. The roughing and the hot rolling conditions and the measured values of the average grain size are shown in Table 2, and the tested results of the cold workability are shown in FIG. 3. O marks in FIG. 3 show that the cold rollings were done without causing cracks, while x marks show that heavy defects occurred or the strips were broken. Further, a curve in the same shows conditions that the spacings between the grain boundaries are $\lambda_0$=0.2 mm as in FIG. 1. It was confirmed therefrom that the tendency obtained in FIG. 1 will be obtained in the actually practiced operations.

TABLE 1

| (wt %) | | | | | |
|---|---|---|---|---|---|
| C | Si | Mn | Sol.Al | P | S |
| 0.007 | 6.57 | 0.17 | 0.73 | 0.007 | 0.003 |

TABLE 2

| | Roughing | | | | | Hot finish rolling | | | | |
|---|---|---|---|---|---|---|---|---|---|---|
| | A (°C.) | B (%) | C (mm) | D (mm) | E (°C.) | B (%) | F λ (mm) | $\lambda_0$ | $(1-\lambda_0/d)\times 100$ [%] | G |
| Com. | 1200 | 77.5 | 45 | 3.8 | 1033 | 84 | 0.60 | 0.19 | 95 | X |
| " | " | " | " | " | " | 89 | 0.42 | " | " | X |
| Inv. | " | " | " | " | " | 95 | 0.18 | " | " | O |
| Com. | " | 83 | 34 | 2.7 | 1025 | 79 | 0.53 | " | 93 | X |
| " | " | " | " | " | " | 85 | 0.40 | " | " | X |
| Inv. | " | " | " | " | " | 94 | 0.16 | " | " | O |
| " | " | " | " | " | " | 95 | 0.14 | " | " | O |
| Com. | " | 85 | 30 | 1.9 | 1010 | 80 | 0.42 | " | 90 | X |
| Inv. | " | " | " | " | " | 91 | 0.16 | " | " | O |
| Com. | 1300 | 82.5 | 35 | 1.2 | 1109 | 69 | 0.39 | " | 84 | X |
| " | " | " | " | " | " | 78 | 0.27 | " | " | X |
| Inv. | " | " | " | " | " | 91 | 0.12 | " | " | O |
| Com. | " | 86 | 28 | 0.8 | 1080 | 60 | 0.33 | " | 76 | X |
| " | " | " | " | " | " | 72 | 0.23 | " | " | X |
| Inv. | " | " | " | " | " | 81 | 0.16 | " | " | O |
| " | " | " | " | " | " | 90 | 0.09 | " | " | O |
| Com. | " | 89 | 22 | 0.3 | 1055 | 31 | 0.22 | " | 37 | X |
| Inv. | " | " | " | " | " | 43 | 0.18 | " | " | |
| " | " | " | " | " | " | 60 | 0.15 | " | " | |

Note:
A: Heating temperature,
B: Total reduction,
C: Thickness of roughed bar,
D: Average grain diameters after rolling,
E: Temperatures at exit of rolling machine,
F: Spacings between grain boundaries in thickness direction,
G: Cold workability,
Inv.: Samples of the invention,
Com.: Comparative samples

(EXAMPLE 2)

High silicon iron alloys having the chemical composition shown in Table 3 were molten in the vacuum melting furnace and cast into ingots. Those ingots were soaked at the temperature of 1150° C. and slabbed (the total reduction: 64%) into 180 mm thickness and further soaked at the temperature of 1150° C. and roughed (the total reduction: 81%) into 35 mm thickness and hot rolled to an objective finish thickness of 3 mm (the total reduction: 91%). The finishing temperature was 765°±10° C. and the coiling temperature was 670°±5° C. Those hot rolled coils were pickled and cold-rolled to 0.5 mm thickness. Table 4 shows the average grain diameters of crop samples of the roughed bars, the average spacings of the grain boundaries and the tested results of the cold workability. With respect to the cold workability, the O marks show the rollings to 0.5 mm thickness without causing cracks, while the x marks show the heavy defects or breakages of the strips.

Table 4 show the result that although the microstructures of the hot rolled plates satisfy the conditions of $\lambda \leqq \lambda_0$, the cold rollings could not be carried out due to the chemical compositions.

TABLE 3

| Samples | (wt %) C | Si | Mn | T.Al | P | S |
|---|---|---|---|---|---|---|
| 1 Invention | 0.004 | 6.48 | 0.13 | 0.52 | 0.009 | 0.009 |
| 2 " | 0.004 | 6.48 | 0.14 | 1.23 | 0.010 | 0.007 |
| 3 " | 0.004 | 6.48 | 0.14 | 1.87 | 0.010 | 0.007 |
| 4 Comparative | 0.004 | 6.49 | 0.14 | 2.20 | 0.009 | 0.008 |
| 5 Invention | 0.002 | 6.51 | 0.15 | 0.49 | 0.011 | 0.007 |
| 6 " | 0.003 | 6.50 | 0.45 | 0.48 | 0.010 | 0.005 |
| 7 Comparative | 0.003 | 6.51 | 0.60 | 0.49 | 0.010 | 0.006 |
| 8 Invention | 0.002 | 6.50 | 0.15 | 0.52 | 0.052 | 0.005 |
| 9 " | 0.003 | 6.51 | 0.16 | 0.51 | 0.087 | 0.006 |
| 10 Comparative | 0.003 | 6.52 | 0.14 | 0.51 | 0.127 | 0.006 |

TABLE 4

| Samples | H (mm) | I (%) | J λ (mm) | | $(1 - \lambda_0/d) \times 100$ (%) | G |
|---|---|---|---|---|---|---|
| 1 Invention | 1.9 | 91 | 0.17 | 0.22 | 88 | ○ |
| 2 " | 2.0 | " | 0.18 | " | 89 | ○ |
| 3 " | 1.9 | 90 | 0.19 | " | 88 | ○ |
| 4 Comparative | 1.6 | 89 | 0.18 | 0.21 | 87 | X |
| 5 Invention | 2.1 | 92 | 0.17 | " | 90 | ○ |
| 6 " | 1.9 | 91 | 0.17 | " | 89 | ○ |
| 7 Comparative | 1.5 | 90 | 0.16 | " | 86 | X |
| 8 Invention | 1.5 | 89 | 0.16 | " | " | ○ |
| 9 " | 1.7 | 91 | 0.15 | " | 88 | ○ |
| 10 Comparative | 1.7 | " | 0.16 | 0.20 | " | X |

Note:
H: Average grain diameter of crop samples of roughed bar,
I: Total reduction of hot finish rolling
J: Spacings between average grain boundaries after hot finish rolling
G: Cold workability

(EXAMPLE 3)

The continuously cast slabs (thickness: 200 mm) having the chemical composition shown in Table 1 were heated at the temperature of 1200° C. for 3 hours, immediately followed by the roughing at the temperature of 1008° C. at the exit sides to 30 mm thickness (the total reduction: 85%). The grain size after the roughing was 1.2 mm. The hot finish rolling with the total reduction of 90% was 90% performed at the surface temperature of 950° C. The finishing temperature was 850° C. and the coiling temperature was 680° C. After the hot rolling, a sample was cut out from the hot rolled coil, and the measured average spacing of the grain boundaries were 0.12 mm. The hot rolled coil was pickled and 83% cold-rolled to 0.5 mm thickness, and undertaken with a box annealing at the temperature of 1000° C. (H2 atmosphere) and measured with AC magnetic properties. Table 5 shows the measured results.

TABLE 5

| AC magnetic properties (Thickness: 0.5 mm) | | | |
|---|---|---|---|
| Iron loss (W/Kg) | | | Saturation induction (Gauss) |
| $W_{10/50}$ | $W_{15/50}$ | $W_{17/50}$ | $B_8$ |
| 0.55 | 1.49 | 1.62 | 15.60 |

If Si content were more than 4 wt %, the effect of cooling in a magnetic field becomes remarkable. Therefore, a sample cut from the coil was annealed at 800° C. for 10 min, and given the magnetizing field of 200 Oe during the subsequent cooling, and AC magnetic properties (after said heating treatment in the magnetizing field) were measured. The results are shown in Table 6.

TABLE 6

| AC magnetic properties (Thickness: 0.5 mm) | | | |
|---|---|---|---|
| Iron loss (W/Kg) | | | Saturation induction (Gauss) |
| $W_{10/50}$ | $W_{15/50}$ | $W_{17/50}$ | $B_8$ |
| 0.48 | 1.21 | 1.28 | 15.62 |

It was apparent that high silicon iron sheets manufactured by the present invention exhibited the excellent soft magnetic properties.

(EXAMPLE 4)

Silicon iron alloys having the chemical composition of Table 7 were molten in the vacuum melting furnace, and cast into ingots and soaked at the temperature of 1180° C. for 3 hours, and slabbed (the total reduction: 60%) into 200 mm thickness, and further soaked at the temperature of 1180° C. for 1 hour and roughed to 35 mm thickness and finished to 2.4 mm in thickness. Those coils were pickled with hydrochloric acid and cold-rolled, and the cold workability was measured with the same appreciations as Example 1. FIG. 8 shows the hot rolling conditions, the average grain size of crop samples after roughing, the hot finish rolled plate and the appreciated results of the cold workability.

TABLE 7

| | (wt %) C | Si | Mn | P | S | T.Al |
|---|---|---|---|---|---|---|
| 1 | 0.007 | 4.2 | 0.13 | 0.010 | 0.003 | 0.43 |
| 2 | 0.006 | 5.6 | 0.12 | 0.009 | 0.002 | 0.45 |
| 3 | 0.007 | 6.6 | 0.12 | 0.009 | 0.002 | 0.45 |
| 4 | 0.007 | 6.8 | 0.14 | 0.009 | 0.003 | 0.44 |

TABLE 8

| C (mm) | D (mm) | K (°C.) | I (%) | L λ (mm) | $\lambda_0$ | $(1 - \lambda_0/d) \times 100$ (%) | G |
|---|---|---|---|---|---|---|---|
| 1 35.2 | 2.6 | 1050 | 93 | 0.18 | 0.81 | 69 | ○ |
| 2 34.6 | 2.5 | 1047 | 93 | 0.18 | 0.44 | 82 | ○ |
| 3 36.0 | 2.3 | 1055 | 94 | 0.15 | 0.19 | 92 | ○ |
| 4 35.7 | 2.3 | 1058 | 93 | 0.17 | 0.13 | 94 | ○ |

Note:
C:Thickness of roughed bar,
D: Average grain diameters after roughing
K: Starting temperature of hot finish rolling
L: Spacing between average grain boundaries in thickness direction of hot rolled plate
G: Cold workability As seen from the above, according to the present method, it is possible to cold-roll high silicon iron alloy containing 4.0 to 7.0 wt % Si.

INDUSTRIAL APPLICATION

This high silicon iron sheet produced by the method of the invention are used as magnetic cores of the electric transformers or materials for other electric devices.

We claim:

1. A method of producing silicon iron sheets having excellent soft magnetic properties, comprising the following steps: (1) melting Fe alloy containing Si: 4.0 to 7.0wt %, Mn: not more than 0.5 wt %, P: not more than 0.1 wt %, S: not more than 0.02 wt %, Al: not more than 2 wt %, (2) making ingot from said alloy or continuously casting said alloy, (3) slabbing-roughing or roughing alloy at a temperature of more than 1000° C. and at total reduction of more than 50%, (4) performing thereon a hot finish rolling at total reduction R shown hereinafter at a temperature of not more than 1100° C. in response to average crystal grain size d before the hot finish rolling, (5) coiling said alloy at a temperature of not more than 750° C., (6) carrying out a descaling treatment thereon, (7) carrying out thereon a cold or warm rolling, and (8) performing annealing thereof; the aforementioned total reduction R being as follows (wherein d(mm) is an average grain size before the hot finish rolling, and $$\lambda_0 = 1.90 - 0.26 \times Si(wt\ \%)):$$

if $d > \lambda_0$, $R(\%) \geqq (1 - \lambda_0/d) \times 100$, and if $d \leqq \lambda_0$, $R(\%) \geqq 0$.

2. A method as claimed in claim 1, including the following step: carrying out, after the finish hot rolling, annealing on the hot rolled strip or plate at a temperature of not more than 750° C. before or after the descaling treatment.

3. A method as claimed in claim 1 or 2, including the following step: carrying out an intermediate annealing at a temperature of not more than 750° C. in the course of the cold or warm rolling.

4. A method as claimed in claim 1, wherein the Si content is more than 5%.

* * * * *